US005273150A

United States Patent [19]

Koivisto et al.

[11] Patent Number: 5,273,150

[45] Date of Patent: Dec. 28, 1993

[54] DEVICE FOR HANDLING RETURNABLE CANS

[75] Inventors: Mika P. Koivisto, Lahti; Jukka T. Luostarinen, Vantaa, both of Finland

[73] Assignee: Halton Oy, Finland

[21] Appl. No.: 857,926

[22] PCT Filed: Aug. 26, 1991

[86] PCT No.: PCT/FI91/00263

§ 371 Date: May 15, 1992

§ 102(e) Date: May 15, 1992

[87] PCT Pub. No.: WO92/05523

PCT Pub. Date: Apr. 2, 1992

[30] Foreign Application Priority Data

Sep. 17, 1990 [FI] Finland ..... 904576

[51] Int. Cl.[5] ..... G07F 7/06

[52] U.S. Cl. ..... 194/209; 209/567; 209/583

[58] Field of Search ..... 194/203, 208, 209, 210, 194/212, 213; 209/524, 567, 583, 596, 636, 653, 930

[56] References Cited

U.S. PATENT DOCUMENTS

| | | | |
|---|---|---|---|
| 2,980,223 | 4/1961 | Stioham | 194/212 X |
| 3,412,837 | 11/1968 | Myers | 194/209 |
| 4,179,018 | 12/1979 | Miller | 194/209 |
| 4,225,047 | 9/1980 | Grubman | 209/636 X |
| 4,257,511 | 3/1981 | Miller | 100/902 X |
| 4,285,426 | 8/1981 | Cahill | 194/209 |
| 4,476,981 | 10/1984 | Yoshida | 209/653 X |
| 4,480,737 | 11/1984 | Jamgochian et al. | 194/213 |
| 4,787,495 | 11/1988 | Tuten et al. | 194/209 X |
| 4,919,274 | 4/1990 | Hammond | 209/583 |

FOREIGN PATENT DOCUMENTS

| | | |
|---|---|---|
| 0074449 | 3/1983 | European Pat. Off. . |
| 9005356 | 5/1990 | PCT Int'l Appl. . |

*Primary Examiner*—F. J. Bartuska

*Attorney, Agent, or Firm*—Steinberg & Raskin

[57] ABSTRACT

The invention relates to a device (10) for handling returnable cans, by means of which device a returnable can is handled mechanically such that it can be formed into a smaller size for transportation and further handling. The device (10) for handling returnable cans includes a press unit (12) arranged below an upper transfer unit (13), which has a conveyor (14) preferably a belt conveyor, on which a returnable can is first placed in an inlet gate (A) on top of an upper run of (14*a*) the belt, run as a closed loop. The equipment further includes a conveyor passage (F) having at least one diagonal side wall surface (16), by means of which a distance is provided between adjacent returnable cans to facilitate the identification and further handling of the returnable can.

20 Claims, 5 Drawing Sheets

DEVICE FOR HANDLING RETURNABLE CANS

BACKGROUND OF THE INVENTION

The invention relates to a device for handling returnable cans, by means of which device a returnable can is handled mechanically such that it can be formed into a smaller size for transportation and further handling and from which device the person returning the can receives a receipt or directly a compensation corresponding to the quantity and/or type of the cans to be returned.

Devices for handling returnable cans are known in prior art, by means of which returnable can is pressed in a press into a smaller size and from which devices the person returning the can receives a receipt or directly a compensation corresponding to the quantity of the returnable items. In known device solutions, the can is placed in a trough, which turns into a position transferring the can to a press. The material and weight of the can are measured before the transfer to the press, whereby a non-accepted can can be transferred to rejection. The identification of the can material occurs by means of an inductive sensor.

OBJECTS AND SUMMARY OF THE INVENTION

An object of the invention is a device solution of a new type, in which the feeding rate of the cans is sufficient, at least 50 cans/min. An object is also to provide a simple device solution, which is thereby reliable in operation and has a simple construction, whereby the constructional costs of the device decrease in comparison with known device solutions.

It has been realized in the invention that it is advantageous to form in connection with the lower press unit of the device for handling returnable cans an upper transfer unit such that said transfer unit comprises a conveyor belt, which transfers the returned can from an inlet gate A along a conveyor passage to the end of the belt run. In this manner, the can, which is received and accepted by the device, is gravitationally transferred further from the end of the belt run to a press, in which the press forms the can into a smaller volume by pressing it between a press drum and a counterplate into a longitudinal plate-like structure.

The inventive device for handling returnable cans is mainly characterized in that the device for handling returnable cans comprises above a press unit an upper transfer unit, which as a conveyor comprises a belt conveyor, on which a returnable can is first placed an inlet gate on top of the upper run of the belt run as a closed loop. The device further includes a conveyor passage comprising at least one diagonal side wall surface, by means of which a distance is provided between adjacent returnable cans to facililite the identification and further handling of the returnable can.

BRIEF DESCRIPTION OF THE DRAWINGS

The invention is next described with reference to certain preferred embodiments of the invention shown in the figures of the accompanying drawings, to which the invention is not intended solely to be limited.

DETAILED DESCRIPTION OF THE INVENTION

Figure 1:
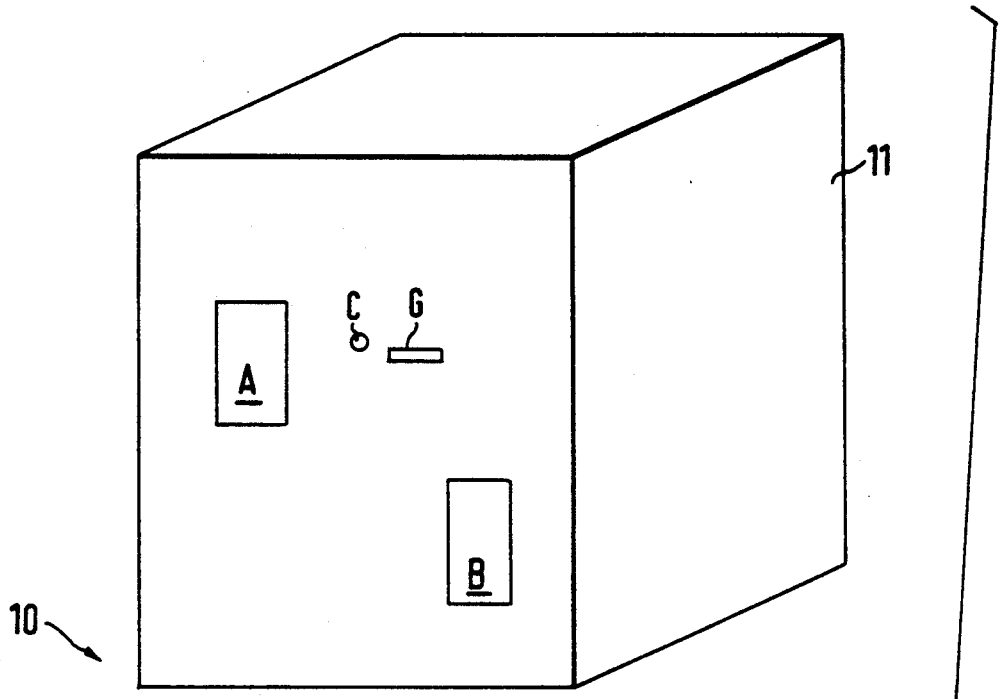
FIG. 1 shows axonometrically an inventive device for handling returnable cans in accordance with the present invention, when its cover has been removed.
Figure 1:
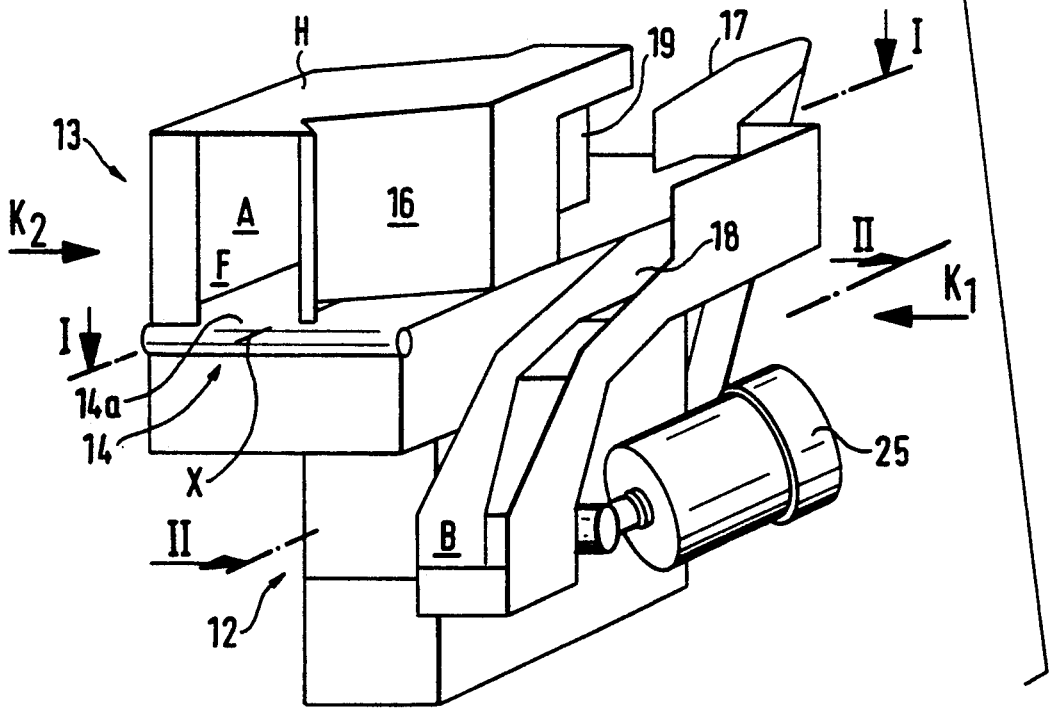

FIG. 1 shows an inventive device 10 for handling returnable cans, which device comprises a cover 11 and above a lower press unit 12 an upper transfer unit 13. (In FIG. 1, the cover 11 is removed from top of the device.) In accordance with the invention, the transfer unit 13 is formed such that it comprises a conveyor 14 and most preferably a belt conveyor. In the figure, a returnable can is fed to an inlet gate A, and if said can is rejected, it is returned to the customer and can be removed from an outlet gate B.

The inventive equipment thus comprises a conveyor passage F on top of a belt run 14*a*. At the end of the belt run 14*a* is located a first passage 17, preferably a trough, via which the returnable can, which has been accepted, is transferred to the press, which forms the can into a smaller volume. A second passage 18 is located at the end of the belt run 14*a* on the other side of the belt run. The second passage is preferably a trough, via which a rejected can gravitationally transfers to the outlet gate B.

The conveyor passage F is comprised of side walls 16 and a ceiling H, and the bottom of the conveyor passage F is formed by the movable belt run 14*a*. According to FIG. 1, the equipment further comprises a device 19, for removing a rejected can from the belt run. The rejection device 19 is preferably a solenoid kicker which transfers the can from top of the the belt run 14*a* to said passage 18 designed for rejected cans. The device 19 preferably comprises a piston part or the like, which hits the rejected can when the can enters at the device 19. In the cover 11, an acknowledgement button is marked with the letter C and an outlet opening for a receipt and/or compensation money is marked with the letter G.

Figure 2:
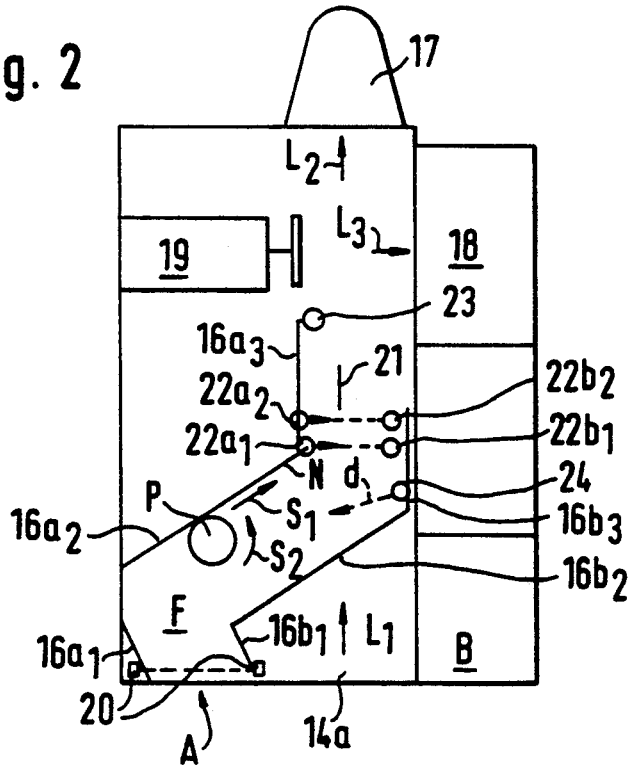
FIG. 2 shows a section I—I of FIG. 1.

FIG. 2 shows a section I—I of FIG. 1. The passage F is bounded by side walls $16a_2$, $16a_2$ and $16a_3$ as well as $16b_1$, $16b_2$ and $16b_3$. The side walls $16a_1$ and $16a_2$, like correspondingly their side walls $16b_1$ and $16b_2$ paralled thereto are located diagonally relative to a center axis X of the belt run 14*a*. According to the figure, the returnable can transfers, conveyed by the belt run, along the passage F such that the returnable can transfers to the side wall $16a_2$. The returnable can transfers in the direction of an arrow $S_1$ and rotates in compliance with the side wall $16a_2$ and along it to a point N at the end of the side wall $16a_2$. From the end of the side wall $16a_2$, the returnable can is guided in compliance with the side wall $16a_3$ to the vicinity of the rejection device 19 in an exact alignment, which is given to said returnable can by the side wall $16a_3$ parallel to the center axis X of the belt run 14a. Since the side wall $16a_2$ in a diagonal position relative to the center axis X of the belt run 14a, it gives the returnable can P a rotational movement $S_2$. The rotation of the returnable can thus occurs against the side wall $16a_2$. The material of the wall $16a_2$ is selected so that it has good frictional properties, whereby the can does not slide on the surface $16a_2$ but rotates in compliance with said surface. The dark and protected space between the walls $16a_2$ and $16b_2$ can then be used for reading a line code. A scanner 24, which reads the line code on the returnable can, is advantageously fitted to the wall $16b_3$, and in the figure, it is according to an arrow d fitted to send a scanning strip along the wall $16a_2$ towards the rotating can P. As the can rotates, the line code on the can in some phase inevitably enters the scanning line, whereby the scanner 24 reads the line code of the returnable can. The purpose of the walls 16 and the ceiling H is also to form such a passage F, from which it is difficult to reach the returnable can, when it has once been transferred to the inlet gate A. The walls thus bound the dark and protected space, which comprises the scanner 24, whereby the reading accuracy of the scanner improves, since external light is prevented from entering into the dark space between the walls $16a_2$ and $16b_2$.

The rotational movement provided for the can by means of the wall $16a_2$ in turn makes it possible that the scanner is capable of reading the line code, since in the rotational movement $S_2$, the line code in some phase enters the scanning line.

An identification device 20 is located in the vicinity of the gate A. The identification device 20 is preferably a photocell, an infrared cell or some other corresponding identification device, by means of which the entry of the returnable can into the gate A is identified. This information is further transmitted to the central unit of the device, which unit starts up a motor 25, whereby the belt 14a receives a rotational movement.

At the initial end of the wall $16a_3$, $16b_2$ are located sensors, preferably light sensors, which are comprised of transmitter/receiver units $22a_1$, $22b_1$, $22a_2$, $22b_2$. The sensors are located one after the other, and by means of them, the travelling direction of the returnable can is identified and possibly also the fact that the returnable can is in a vertical position on top of the belt run 14a. An incorrect use is eliminated by means of the above-mentioned light-sensor devices, since the travelling direction of the returnable can is determined by means of the light sensors, and when the travelling direction is the direction $L_1$, an acceptance signal is given thereof. After the transmitter/receiver light sensor devices is located a weight identification device 21, preferably a strain-gauge transducer located under the belt 14a. After the weight identification device 21 is then located a material identification device 23, preferably an inductive sensor, which checks the material of the returnable can, and when it detects that e.g. a steel can is concerned, the central unit starts up the rejection means, i.e., a kicker 19, after a certain delay. The kicker 19 which transfers a rejected returnable can from the belt run 14a to the passage 18, which is preferably a trough, via which the non-accepted can is transferred to the outlet gate B. From the gate B, the customer can pick up the non-accepted returnable can back to her/himself.

FIG. 2 further shows the above-mentioned branching point, whereby an accepted can transfers from the end of the belt conveyor in the direction of the arrow $L_2$ directly to the passage 17 and to the press, and a rejected can transfers in the direction of the arrow $L_3$ to the passage 18 and to the gate B.

Figure 3:
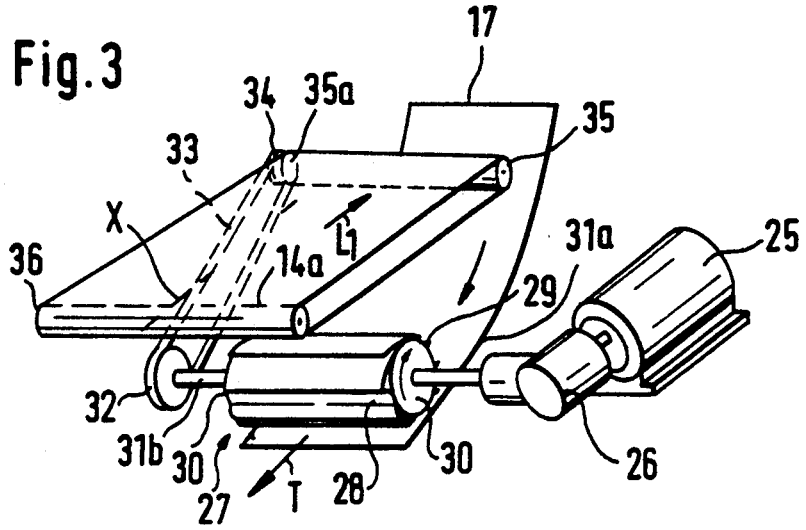
FIG. 3 shows axonometrically, partially the inventive device in accordance with the invention with its main drive.

FIG. 3 illustrates the actuators of the inventive device. The motor 25 is preferably an electric motor, which rotates via a herringbone gear 26 a press drum 27 of the press unit 12.

The press drum 27 comprises a shell 28 and therein wings 29 or the like. The ends of the shell 28 have end flanges 30, which comprise shafts 31a and 31b. The shaft 31b, on the side opposite to the motor 25, is connected to a belt pulley 32. The motor 25 is preferably an electric motor. When the press drum 27 is thus rotated in the directions of the arrows, the belt pulley 32 is rotated and a belt 33 is moved, which is as a closed loop guided via the first belt pulley 32 and a second belt pulley 34. The belt pulley 34 is connected to a first turning roll 35 of the belt run 14a, to its shaft 35a, and provides a drive for the belt run 14. A second turning roll 36 of the belt run 14 is located near the inlet gate A. The turning rolls 36 and 35 are mounted on the body of the device with bearing devices (not shown).

Figure 4:
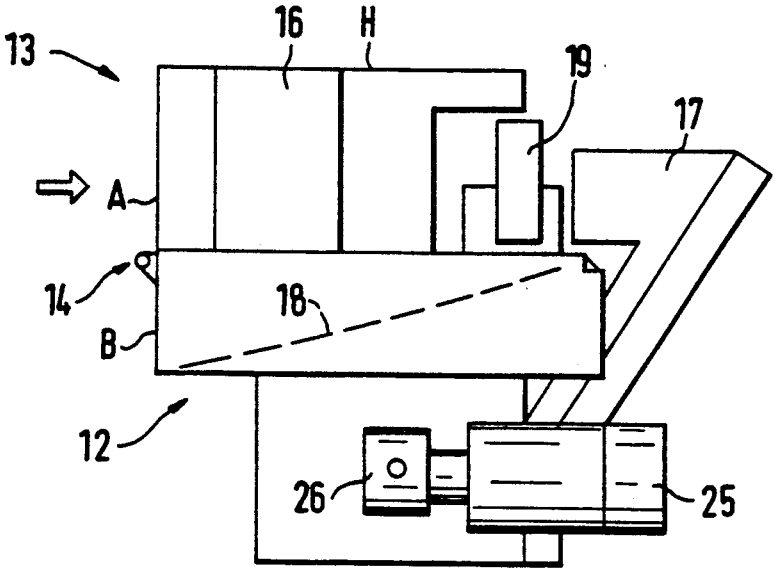
FIG. 4 shows a view of FIG. 1 from the direction of the arrow $K_1$.

FIG. 4 shows the inventive device from the direction of the arrow $K_1$ of FIG. 1.

Figure 5:
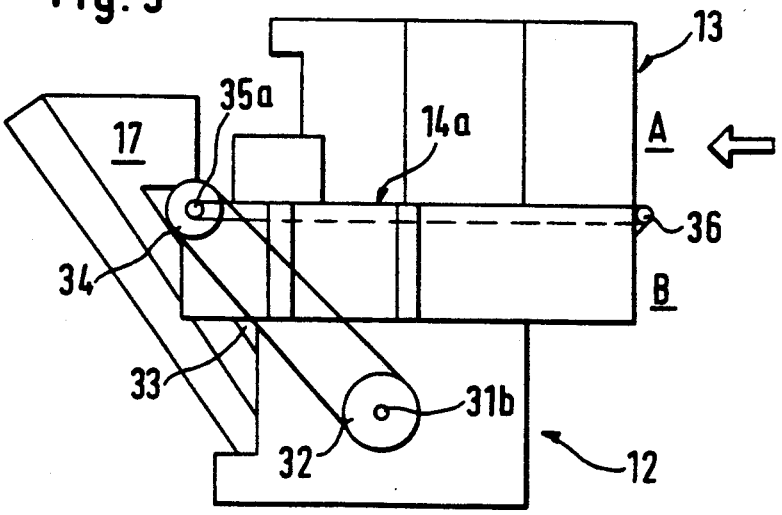
FIG. 5 shows the equipment of FIG. 1 from the direction of the arrow $K_2$.

FIG. 5 shows the device of the figure seen from the direction of the arrow $K_2$ of FIG. 1.

The rotational drive of the belt 14a of the transfer conveyor 14, preferably a belt conveyor, is preferably thus taken from the belt 33 shown in FIG. 5, which is further driven by one end shaft 31b of the press drum 27. One motor 25 thus rotates the conveyor belt 14a and the press drum 27. When the placement of a can on the belt run 14a is detected by the identification device 20, preferably a photocell, the motor 25 automatically starts up.

Figure 6:
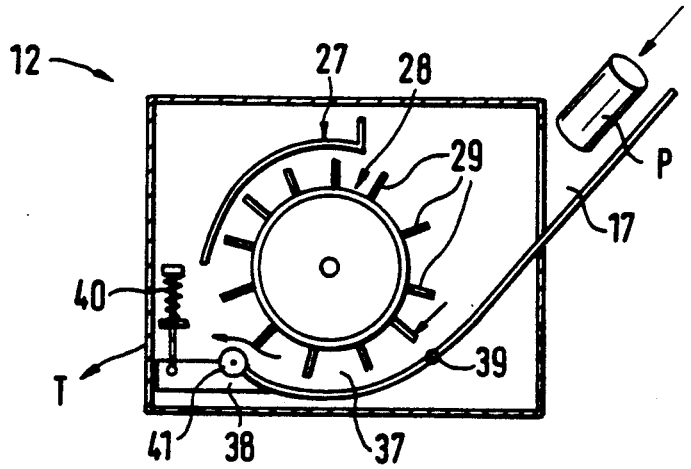
FIG. 6 shows a section II—II of FIG. 1.

FIG. 6 shows a section II—II of FIG. 1. The press unit 12 comprises the press drum 27, between the shell 28 and a counterpart 38 of which forms a wedge-like press gap 37. When the press drum 27 is rotated, the wings 29 transfer the returnable can by force into the wedge-like gap 37, which narrows in a wedge-like manner. The returnable can is formed into a flat longitudinal space-saving form. According to FIG. 6, the counterpart 38 is fitted to turn at an articulated point 39 against the spring force of a spring 40. The press drive thus receives flexibility, since the counterpart 38 can be moved against the spring force of the spring 40. In addition, the counterpart 38 is provided with a rotatable roll 41, which facilitates the travelling of the can at the narrowest point of the gap 37 and the removal of the can from the gap and further to a storage T.

It is also possible to use in the invention an embodiment, in which the conveyor is driven directly by its own motor, preferably an electric motor, which connects from its outlet shaft either directly or via a gear system to the roll driving the belt 14a.

Figure 7:
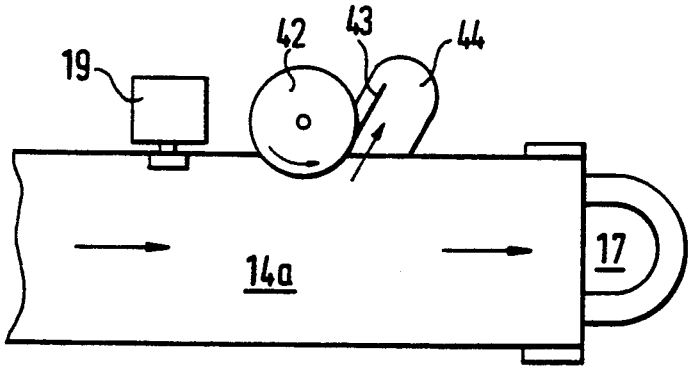
FIG. 7 shows an embodiment of the inventive device, in which the returnable cans are sorted into aluminium cans and steel cans.

FIG. 7 illustrates an embodiment, in which both aluminium cans and steel cans are crushed. The equipment is provided with a magnetic wheel 42, whereby the steel cans stick to the magnetic wheel and transfer, loosened by a guide 43, to a passage 44, which transfers the returned steel can to its own press or to a certain sector of the press drum. The aluminium can transfers directly on the belt run 14a to a passage located at the end of the belt run, which passage transfers the aluminium can to its own press or to a certain sector of the same press. In the embodiment of FIG. 7 is given a receipt for or directly a compensation corresponding to the returned number of steel cans and aluminium cans.

Figure 8:
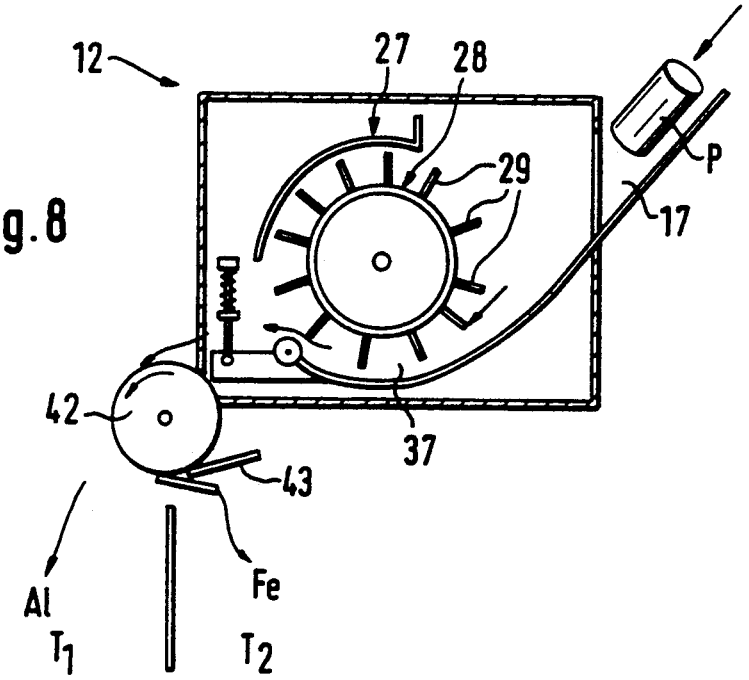
FIG. 8 shows an embodiment of the inventive device, in which the cans are separated by means of a magnetic wheel after the press unit.

FIG. 8 shows an embodiment of the inventive device, in which the aluminium cans and the steel cans are separated after the press drum by the rotatable magnetic wheel 42, which is fitted after the press gap 37. The magnetic wheel 42 transfers e.g. the aluminium cans directly to a storate station $T_1$ located below the magnetic wheel 42, whereas the steel cans stick to the magnetic wheel 42, which transfers them above a storage $T_2$, where the guide 43 loosens the steel can magnetically stuck to the magnetic wheel 42 from the magnetic wheel 42. The steel can then drops into its own storage $T_2$. In this embodiment of the invention, one press unit can thus be used and the separation of the Al/FE cans occurs after the pressing occurrence.

Figure 9:
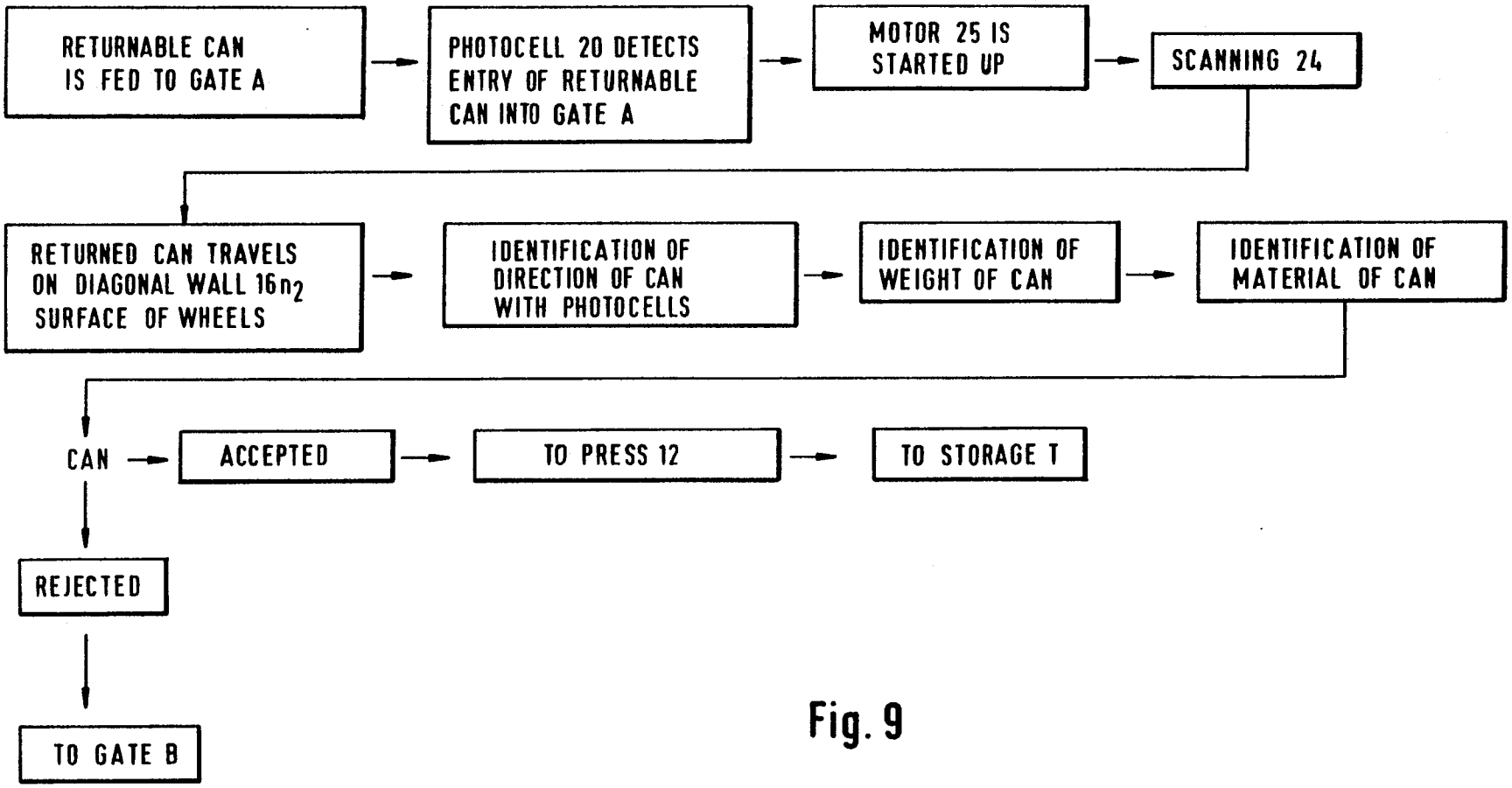
FIG. 9 shows the operation of the inventive device as a block diagram representation.

FIG. 9 is a block diagram representation of the operation of the inventive device. In the first step, the returnable can is fed into the inlet opening A. The photocell detects the returned can and starts up the motor. In the next step, the line code is scanned, as the returnable can travels on a diagonal surface diagonally relative to the center axis X of the conveyor and diagonally relative to the travelling direction of the conveyor belt. In the next step, a pair of photocells identifies the travelling direction of the can. After this, the weight is identified from under the belt by the weight identification device 21, preferably a strain-gauge transducer, and in the final step, an inductive sensor identifies the material of the returnable can. If the can is accepted, the solenoid does not react and the can transfers to a passage leading to the press. If the can is rejected, the solenoid or some other corresponding rejector transfers the non-accepted returnable can to its own conveyor passage, from which the can transfers back to the vicinity of the front panel of the device, where is located the outlet gate B for rejected returnable cans.

We claim:

1. A device for mechanically handling returnable cans and decreasing the size of the cans, comprising a press unit for pressing returnable cans, checking means for checking whether a returnable can is accepted or rejected and whether a receipt and/or a compensation is provided for the can, transfer mean coupled to said press unit, the can being transferred by said transfer means to said press unit after the can has been accepted, said transfer means comprising a transfer unit including a closed loop belt conveyor having an upper run for carrying the cans in a travelling direction of said upper belt run; and inlet gate situated at an upstream end of said upper belt run for receiving cans; a conveyor passage having at least one diagonal side wall situated downstream from said inlet gate and forming an angle with the travelling direction of said upper belt run, said inlet gate being substantially aligned with said at least one diagonal side wall in the travelling direction of said upper belt run, said at least one diagonal side wall extending across said upper belt run to an extent that the cans received at said inlet gate are necessarily carried on said upper belt run into contact with said at least one diagonal side wall to move along the same to thereby increase the space between the cans.

2. The device of claim 1, wherein said transfer unit has additional side walls and a ceiling arranged in proximity to said upper belt run to thereby define said conveyor passage between said additional side walls, said ceiling, said at least one diagonal side wall and said upper belt run such that an enclosed space is formed in said conveyor passage, said device further comprising a scanner operating in said enclosed space.

3. The device of claim 2, wherein said scanner is structured and arranged to send a scanning strip in a direction along said at least one diagonal side wall such that an identification code on the can is scanned by said scanner during a rotational movement of the can along said at least one diagonal side wall.

4. The device of claim 2, wherein said additional side walls comprise a plurality of opposing parallel walls, one of said additional side walls being opposite and parallel to said at least one diagonal side wall, a surface of said at least one diagonal side wall facing said conveyor passage having friction properties such that the cans rotated substantially over the entire length of said at least one diagonal side wall.

5. The device of claim 4, further comprising rejection means arranged after said conveyor passage for handling a rejected can, a pair of said additional walls being arranged in proximity to said rejection means and parallel to the travelling direction of said upper belt run such that the rejected can is directed by one of said pair of additional walls to said rejection means.

6. The device of claim 1, further comprising rejection means for handling a rejected can, said rejection means being arranged after said at least one diagonal side wall and comprising an outlet gate and equipment for removing the rejected can from said upper belt run and transferring the rejected can through a trough to said outer gate, said outlet gate being located in proximity to said inlet gate on a front panel of the device.

7. The device of claim 6, wherein said equipment for removing the rejected can comprises a solenoid kicker.

8. The device of claim 1, further comprising identifying means for identifying placement and entry of the can in said inlet gate, and a motor arranged to rotate a belt of said belt conveyor via a press drum upon entry of the can into said inlet gate such that the cans are carried on said upper belt run.

9. The device of claim 1, wherein said press unit is arranged under said transfer unit, said device further comprises a vertically oriented trough leading away from said belt conveyor such that an accepted can is transferred substantially by the effect of gravity from said upper belt run to said press unit.

10. The device of claim 6, wherein said press unit is arranged under said transfer unit, said trough being vertically oriented and directed away from said belt conveyor such that the can is transferred substantially by the effect of gravity from said upper belt run to said outlet gate.

11. The device of claim 1, wherein said transfer means further comprises a passage through which the can is passed from said transfer unit to said press unit, said press unit comprising a press drum having wing-shaped pieces arranged on a shell, a motor for rotating said press drum, and a counterpart arranged in proximity to said press drum to thereby define a gap which narrows in a wedge-like manner in a pressing direction, the can being fed from said passage into said gap such that the can is pressed by said press drum into a longitudinally flat space-saving form by the action of the wedge effect between said counterpart and said press drum, the pressed can being transferred from said press drum to a storage for pressed cans.

12. The device of claim 11, further comprising a shaft connected to one end of said press drum, a first belt pulley connected to said shaft, a second belt pulley, a belt arranged to run over said first and second belt pulleys, and a turning roll having a shaft connected to said second belt pulley and arranged in a loop of said belt conveyor, such that said motor is arranged to drive said belt conveyor and said press drum.

13. The device of claim 1, further comprising drive means for driving said belt conveyor.

14. The device of claim 1, further comprising identification devices for identifying a travelling direction of the can in said conveyor passage, whereby an acknowledgement for the can is not given until after the can has passed said identification devices and whereby compensation is not given for the can if the identified travelling direction of the can is not the travelling direction of said upper belt run, material identification means for identifying the material of the can, and rejection means arranged after said material identification means in the travelling direction of said belt conveyor, said rejection means transferring the can away from said upper belt run when said material identification means identify a non-acceptable can material.

15. The device of claim 6, further comprising sensor means arranged underneath said upper belt run, said sensor means identifying the weight of the can, said rejection means being arranged after said sensor means in the travelling direction of said upper belt run and transferring the can away from said upper belt run when said sensor means identify a non-acceptable can weight, said sensor means comprising a strain-gauge transducer.

16. The device of claim 1, further comprising a cover arranged to enclose said device there, said cover having a first and second opening, a turning roll arranged in said belt conveyor for turning said belt conveyor, said inlet gate being defined between said first opening and said turning roll, said second openings defining an outlet gate through which non-accepted cans are returned, said cover having a third opening corresponding to an acknowledgement button for acknowledging receipt of the can, and a fourth opening through which a return receipt and/or return money is dispensed.

17. The device of claim 1, wherein said device is structured and arranged to accept both steel cans and non-steel/aluminum cans, said device further comprising a magnetic wheel arranged in proximity to said upper belt run and structured and arranged to move a steel can adhering thereto, and a guide for releasing the steel can from said magnetic wheel, the steel can being released from said magnetic wheel and transferred to a passage leading to a press device, the non-steel cans being transferred past said magnetic wheel to an end of said upper belt run, whereby a return money or a receipt is given both for steel cans and non-steel cans.

18. The device of claim 1, wherein said device is structured and arranged to accept both steel cans and non-steel/aluminum cans, said device further comprising a magnetic wheel arranged after said press drum, the non-steel cans being dropped by the effect of gravity from said magnetic wheel to a first storage station and the steel cans adhering to said magnetic wheel and being transferred to a second storage station, the steel cans being loosened from said magnetic wheel in the vicinity of a guide such that the steel cans drop into said second storage station, whereby the cans are sorted in said device and the steel and non-steel cans are both pressed by said press unit.

19. The device of claim 11, further comprising a spring connected to said counterpart for providing flexibility to said counterpart as the can is being pressed by said press drum against said counterpart.

20. A device for mechanically handling returnable cans and decreasing the size of the cans, comprising a press unit for pressing returnable cans, checking means for checking whether a returnable can is accepted or rejected and whether a receipt and/or a compensation is provided for the can, transfer means coupled to said press unit, the can being transferred by said transfer means to said press unit after the can has been accepted, said transfer means comprising a transfer unit having a closed loop belt conveyor, the cans being placed in an inlet gate formed on a top surface of an upper run of said belt conveyor, said transfer unit including a conveyor passage having at least one substantially planar diagonal side wall arranged in an angular position relative to a travelling direction of said belt conveyor, said at least one diagonal side wall extending across said upper belt run to an extent that the cans received at said inlet gate are necessarily carried on said upper belt run into contact with said at least one diagonal side wall and along said at least one diagonal side wall at an angle to the travelling direction of said conveyor and being rotated substantially over the entire length of said at least one diagonal side wall such that the space between successive cans placed in said inlet gate is increased.

* * * * *